US005897774A

United States Patent [19]

Cope

[11] Patent Number: 5,897,774

[45] Date of Patent: Apr. 27, 1999

[54] CENTRIFUGAL SEPARATOR WITH ANGULATED VANES

[75] Inventor: Dewey M. Cope, St. Louis, Mo.

[73] Assignee: Elgin National Industries, Inc.

[21] Appl. No.: 09/009,474

[22] Filed: Jan. 20, 1998

Related U.S. Application Data

[63] Continuation-in-part of application No. 08/598,244, Feb. 8, 1996, Pat. No. 5,720,879.

[51] Int. Cl.[6] ..... B04B 1/08; B04B 1/12

[52] U.S. Cl. ..... 210/369; 210/360.1; 210/369; 210/380.1; 210/380.3; 494/36; 494/43; 494/60

[58] Field of Search ..... 210/369, 377, 210/380.1, 380.3; 494/36, 43, 60

[56] References Cited

U.S. PATENT DOCUMENTS

| | | |
|---|---|---|
| 3,279,611 | 10/1966 | Von Rotel . |
| 4,135,659 | 1/1979 | Derton et al. . |
| 4,900,442 | 2/1990 | Connolly et al. . |
| 5,720,879 | 2/1998 | Cope . |

*Primary Examiner*—David A. Reifsnyder
*Attorney, Agent, or Firm*—Paul M. Denk

[57] ABSTRACT

In a centrifugal apparatus for separating wetting material carried on particulate matter or chips, such apparatus includes a truncated conical shaped bowl into which the particulate matter or chips are deposited for centrifugal separation. A number of equidistantly spaced and radially aligned vanes are secured to the inner surface of the bowl adjacent the truncated end to collect incoming particulate matter or chips, and to establish a buffer layer, reducing the abrasion on the bowl caused by the insertion of further particulate matter or chips.

5 Claims, 2 Drawing Sheets

CENTRIFUGAL SEPARATOR WITH ANGULATED VANES

CROSS-REFERENCE TO RELATED APPLICATIONS

This application is a continuation-in-part of U.S. patent application Ser. No. 08/598,244 filed on Feb. 8, 1996, now U.S. Pat. No. 5,720,879.

STATEMENT REGARDING FEDERALLY SPONSORED RESEARCH OR DEVELOPMENT

None.

BACKGROUND OF THE INVENTION

This invention relates generally to the centrifugal separation of granular material, shredded material, or other particulate such as coal, scrap, and the like, from the wash water, or conveying fluids, or other liquid material, and more specifically, to improvements in the durability of the components of the centrifugal separator as affected by the centrifugal action in separating such material from the conveying fluids.

Various types of centrifugal separating apparatuses are represented in the prior art. The prior art apparatuses are usually constructed for distributing the liquid wetted granulated material, the crushed material, or chips, into the centrifugal separator without regard to the abrading effect the moistened particulate may have on the separating apparatus. This is especially true when the material of the particulate matter approaches the same characteristics as the material or components employed in the separator apparatus. For example, shredded or crushed metal components, such as the type normally fed through a crusher, may be formed of metal similar in composition to that from which the components of the centrifugal separator are fabricated. When the particulate matter has that characteristic, its abrading action upon select components of the separating apparatus can be very destructive, particularly when the apparatus operates over a period of time, with the frictional forces involved leading towards, in some instances, a rather prompt erosion of the component structure, which can lead towards an eventual breakdown of the centrifugal separating apparatus. As a result, expensive parts to the separator must be replaced, due to their shortened life, which can effect the overall useful life of the components and the separating apparatus itself, raise the cost of its maintenance, which may not have been anticipated in its life span and accounting when the apparatus was originally obtained.

The most relevant prior art known is the Derton, et al. U.S. Pat. No. 4,135,659, and the Conn-Weld U.S. Pat. No. 4,900,442. U.S. Pat. No. 4,135,659, owned by a common assignee, is incorporated herein by reference.

It is therefore, the principal object of this invention to provide a means to extend the useful life of select components of a centrifugal separator, in order to reduce the installing expense, maintenance of the apparatus over its life span, and to extend the useful life span of the equipment.

BRIEF SUMMARY OF THE INVENTION

The primary object of this invention is to provide a centrifugal separator wherein the material holding vanes which sustain the particulate during functioning of the centrifuge have a placement that provides a better hold to the incoming particulate material, and thereby reduce the incidence of frictional abrasion inherent in the prior art designed apparatuses.

A further object of this invention is to extend the useful service life of a centrifugal separator apparatus by providing a buffer layer between the incoming material and the centrifugal components, especially in situations where the wetted separated material may be especially abrasive upon the component structure when subjected to the velocities encountered in the operations of the centrifugal separator.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Figure 1:
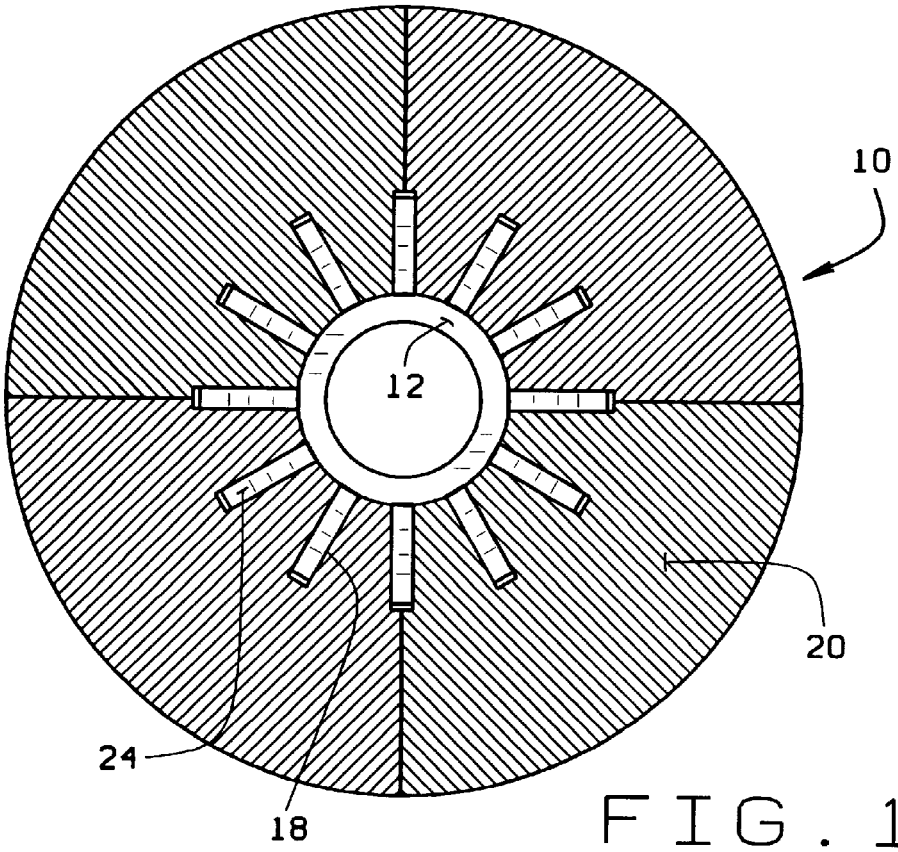
FIG. 1 is an end view of a centrifugal deflector bowl for a centrifugal separation.
Figure 2:
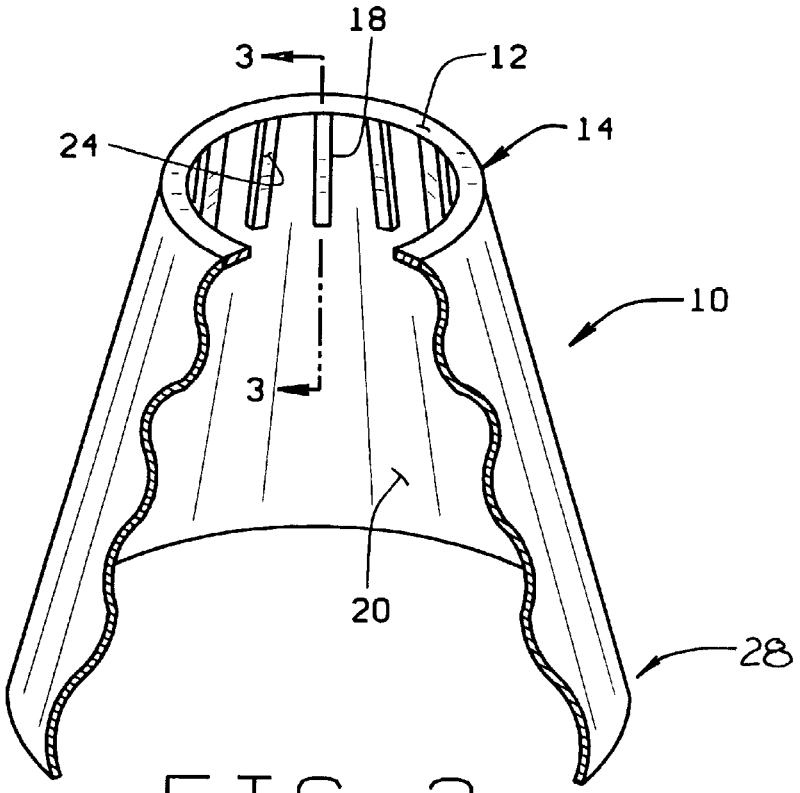
FIG. 2 is cut-away illustration of the centrifugal deflector bowl of FIG. 1.
Figure 3:
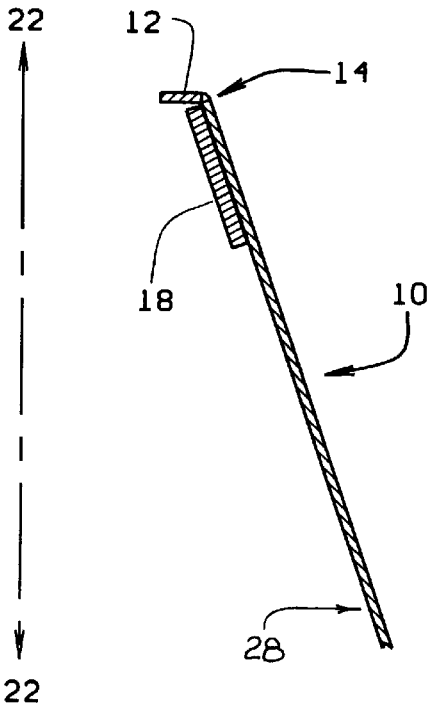
FIG. 3 is a sectional view of the centrifugal deflector bowl of FIG. 1, taken along line 3—3 in FIG. 2.

Referring to FIGS. 1 and 2, a revolving centrifugal bowl or screen 10 is shown in the shape of a truncated cone. The centrifugal screen 10 includes a mounting ring 12 located at the truncated end 14 for attachment of the screen to a rotating shaft within a centrifugal separator (not shown). During operation, particulate material or chips 16 along with a carrier fluid, are deposited within the interior of the centrifugal screen 10, adjacent the truncated end 14. A plurality of vanes 18 secured to the inner surface 20 of the screen 10, adjacent the truncated end 14, present impact surfaces and collection points for the deposited chips 16. As seen in FIGS. 2 and 3, each identical vane 18 is radially mounted, and equidistantly spaced from adjacent vanes. In the preferred embodiment, vanes 18 are of sufficient length to extend from the truncate end 14 to beyond the region in the screen 10 wherein the deposited chips 16 initially impact.

Figure 4:
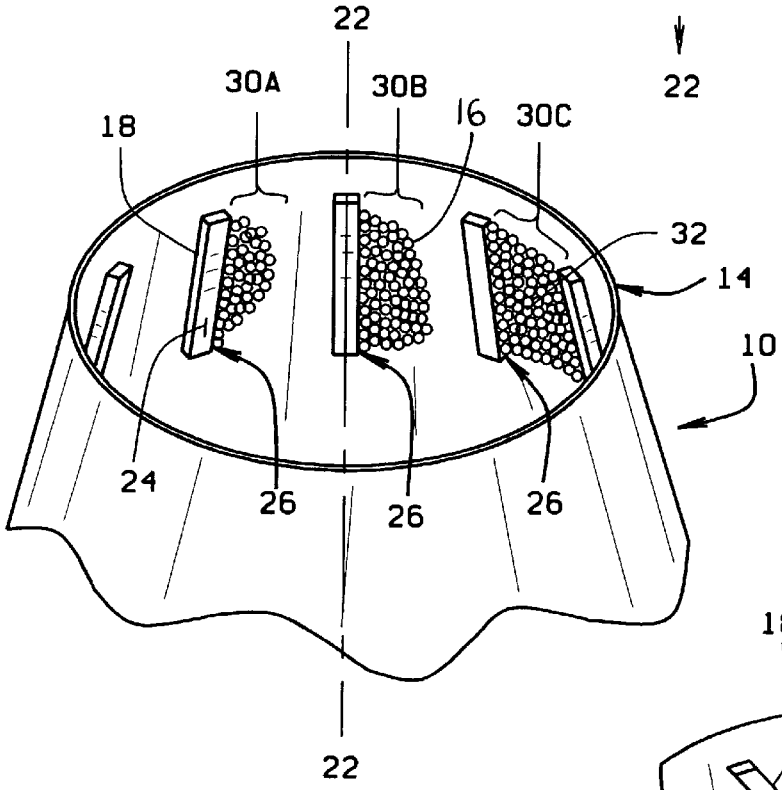
FIG. 4 is an illustration of the centrifugal deflector bowl of FIG. 1, illustrating the buildup of particulate within the bowl.

The improvement of this device is best illustrated in FIG. 4 to show the action of the vanes 18. In this illustration, the rotation of the screen 10 is clockwise about the rotation axis 22 of the screen. As chips 16 and carrier fluids are deposited within the screen 10 adjacent the truncated end 14, they initially impact the screen 10 at high velocity, causing excessive wear and tear. Some of this wear and tear is absorbed by the width of the inner face 24 of the vanes 18. However, the key functionality of the vanes 18 is to provide a collection point for the chips 16. Chips which are initially deposited between adjacent vanes 18 are moved by centrifugal force in a counterclockwise direction, eventually impacting the leading edge 24 of a vane 18. The chips 16 are temporarily held against this leading edge 26, until drawn by gravity towards the base 28 of the screen 10. The carrier fluid is separated from the chips 16 by centrifugal force, and ejected through the screen 10.

Initially, the number of chips 16 held against the leading edge 26 of a vane is small, as indicated by 30A in FIG. 4. However, as the centrifugal separator continues to operate, and more chips 16 are deposited within the screen 10, the quantity of chips 16 held against the leading edges increases, eventually completely covering the portion of the screen 10 between each vane 18, as indicated by 30B and 30C. This covering of chips 16 acts as a buffer layer, filter cushion, or mat 32 for the screen 10 against the impact of further particulate material deposited within the screen. Chips 16 freshly deposited within the screen 10 serve to replenish the buffer layer, filter cushion, or mat 32, filling in gaps created as chips 16 are drawn by gravity towards the base 28. By establishing the buffer layer 32 between the incoming chips 16 and the screen 10, the abrading action and frictional forces which can lead to an eventual breakdown of the centrifugal separating apparatus and more particularly to its screen 10 at this location is greatly reduced, significantly extending the operational lifespan of the device.

Figure 5:
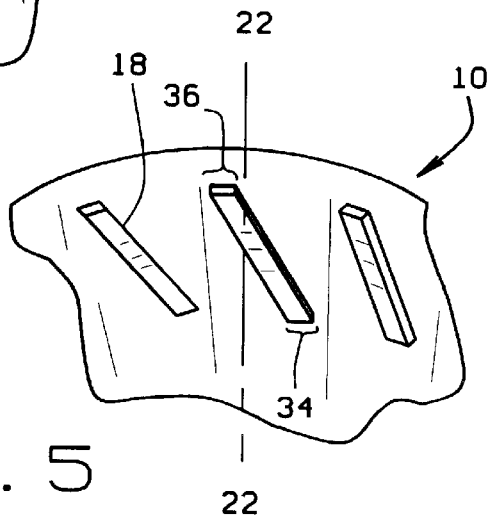
FIG. 5 is an enlarged view of the interior of a centrifugal deflector bowl, illustrating an alternate embodiment of the present invention.

In view of the above, it will be seen that the several objects of the invention are achieved and other advantageous results are obtained. One skilled in the art will recognize that various changes could be made to the design of the vanes 18 without departing from the scope of the invention. For example, as seen in FIG. 5, the vanes could be angularly arranged relative to the rotation axis 22, having a leading end 34 and a trailing end 36 to aid in retaining chips 16. Additionally, the dimensions of the vanes 18, such as the inner face 24 or length may be optimally altered to reflect the size and shape of the chips 16 which are to be centrifugally separated.

As these and other various changes could be made in the above constructions without departing from the scope of the invention, it is intended that all matter contained in the above description or shown in the accompanying drawings shall be interpreted as illustrative and not in a limiting sense.

What is claimed is:

1. For use in a centrifugal separating apparatus for centrifugally separating a liquid wetting on incoming particulate matter from the respective materials, a centrifugal screen comprising:

(a) a conic shaped bowl comprising a truncated screen having a truncated end at the small diameter and a base at its opposite end;

(b) means connected to said truncated end of the screen to rotate said bowl about an axis;

(c) a plurality of material holding devices secured interiorly of said screen adjacent said truncated end, said material holding devices spaced evenly around said screen, said material holding devices further having a lengthwise dimension arranged relative to said axis of rotation, the area swept by said material holding devices during rotation of said screen approximating the area of initial impact on said screen of said incoming particulate matter; and (d) said material holding devices comprising linear vanes, said vanes collecting and temporarily holding said incoming particulate matter against an interior surface of said screen to develop a buffer layer formed of said particulate matter, said buffer layer reducing abrasion of the screen by said further incoming particulate matter.

2. The centrifugal screen of claim 1 wherein said axis of rotation of said screen is a horizontal axis.

3. The centrifugal screen of claim 1 wherein said axis or rotation of said screen is a vertical axis.

4. The centrifugal screen of claim 1 wherein said lengthwise dimension of each of said plurality of vanes is arranged parallel to said axis of rotation of said screen.

5. The centrifugal screen of claim 1 wherein said lengthwise dimension of each of said plurality of vanes is arranged angularly to said axis of rotation of said screen to lean into the direction of rotation of said screen, each of said plurality of vanes having a trailing end adjacent said truncated end, and leading end facing said screen base outlet.

* * * * *